US011607904B2

(12) United States Patent
Verheijen

(10) Patent No.: US 11,607,904 B2
(45) Date of Patent: Mar. 21, 2023

(54) PAINTBRUSH HOLDER

(71) Applicant: Hubertus Gerardus Jacobus Verheijen, Vught (NL)

(72) Inventor: Hubertus Gerardus Jacobus Verheijen, Vught (NL)

( * ) Notice: Subject to any disclaimer, the term of this patent is extended or adjusted under 35 U.S.C. 154(b) by 0 days.

(21) Appl. No.: 17/281,541

(22) PCT Filed: Sep. 26, 2019

(86) PCT No.: PCT/NL2019/050647
§ 371 (c)(1),
(2) Date: Mar. 30, 2021

(87) PCT Pub. No.: WO2020/071904
PCT Pub. Date: Apr. 9, 2020

(65) Prior Publication Data

US 2021/0387471 A1 Dec. 16, 2021

(30) Foreign Application Priority Data

Oct. 1, 2018 (NL) ..... 1043016
Jan. 3, 2019 (NL) ..... 2022341

(51) Int. Cl.
*B44D 3/12* (2006.01)
*A46B 17/04* (2006.01)

(52) U.S. Cl.
CPC ..... *B44D 3/125* (2013.01)

(58) Field of Classification Search
CPC ..... B44D 3/125
USPC ..... 206/15.2, 15.3, 361
See application file for complete search history.

(56) References Cited

U.S. PATENT DOCUMENTS 816,793 A 4/1906 Harris
1,000,426 A 8/1911 Merritt
2,782,909 A * 2/1957 McNamara ..... B44D 3/125 220/802

(Continued)

FOREIGN PATENT DOCUMENTS

WO 2017084672 A1 5/2017

*Primary Examiner* — Luan K Bui
(74) *Attorney, Agent, or Firm* — AEON Law, PLLC; Adam L. K. Philipp; David V. H. Cohen

(57) ABSTRACT

The invention relates to a paintbrush holder (1), comprising a brush-receiving part (2) that is open at the top for receiving a brush, with a volume, a spout-shaped part (3) provided on an upper side of the brush-receiving part, wherein a largest diameter of the spout-shaped part is larger than a largest diameter of a paintbrush to be received in the brush holder, wherein a lower and smallest diameter of the spout-shaped part fits the diameter of the head of the paintbrush, the volume of the brush-receiving part below the smallest diameter is larger than the volume of the brush hairs, in which at least a part of the paintbrush holder comprises an elastomer (4), which elastomer is provided at the smallest diameter of the spout-shaped part, which elastomer is adapted for sealing the volume in a fluid-tight manner, and in which the spout-shaped part has a height such that a mass center of gravity (5) of a paintbrush to be received, falls into the paintbrush holder.

In another embodiment of the invention, the holder consists of more rigid material like plastic, glass or metal like aluminum and the brush head consists fully or partly of an elastomer.

13 Claims, 4 Drawing Sheets

(56) References Cited

U.S. PATENT DOCUMENTS

| | | | | | |
|---|---|---|---|---|---|
| 4,847,939 | A * | 7/1989 | Derencsenyi | A46B 17/04 | 16/110.1 |
| 5,022,559 | A * | 6/1991 | Condon | B44D 3/121 | 401/122 |
| 5,992,617 | A * | 11/1999 | Couch | B44D 3/125 | 215/390 |
| 6,450,336 | B1 * | 9/2002 | Edes | A46B 17/04 | 206/209 |
| 2002/0000388 | A1 | 1/2002 | Frisk | | |
| 2004/0129580 | A1 * | 7/2004 | Cochran | A47K 1/09 | 206/361 |
| 2013/0299362 | A1 * | 11/2013 | DePaola, Jr | B44D 3/125 | 53/467 |

* cited by examiner

PAINTBRUSH HOLDER

RELATED APPLICATIONS

This application is a U.S. National Phase of, and claims priority to, PCT International Phase Application No. PCT/NL2019/050647, filed Sep. 26, 2019, which claims priority to a Netherlands Patent Application No. NL1043016, filed Oct. 1, 2018, and a Netherlands Patent Application No. NL2022341, filed Jan. 3, 2019. The entire contents of the above-referenced applications and of all priority documents referenced in the Application Data Sheet filed herewith are hereby incorporated by reference for all purposes.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

STATE OF THE ART

The invention relates to a paintbrush holder described in the preamble of claim 1. This paintbrush holder protects the brush against drying out and damage.

Such a product is known, for example from patent WO2007/087202 A2. The product concerns a temporary housing consisting of an upper part which has a recess for the brush handle and one lower part large enough to hold the brush and that connects to the upper part such that the brush is almost airtight sealed.

Another known product is displayed in U.S. Patent No. 2002/0000388 A1. Herein a product is described consisting of a two-part container of which the upper side is provided with an elastic membrane that gives an almost airtight seal with the brush handle.

These known products have the advantage that one random brush can be stored for some time without drying out but the disadvantage is that the rubber collar around the brush handle is hindering when painting. Also, after use, the remove of the collar will cause a dirty brush handle.

Another drawback is that the closure is not completely air- or watertight so that cleaning agents such as water and white spirit will evaporate and the brush will dry out.

Another drawback is that the brush rests usually on the points of the hair causing damage to it and diminishes the quality of use.

Another drawback is that the container is quite large so that it takes up a lot of space, often for just one or two brushes and it needs a lot of fluid. When using multiple brushes each for a different color these must, if they come together in liquid in a container, all be properly cleaned to be able to use them again. In addition, the use is often time-consuming also when storing the brush during a paint job. Because of the size, it is not possible to take it along in the pocket for example during climbing a ladder.

Another known product is shown in Dutch Patent Specification 1000426 describing a brush with a rubbery ring just above the brush head with hair that fits exactly on a holder in which the brush can be stored airtight. This method has the advantage that the hair does not damage.

A drawback of this method is that an adjustment to the brush must take place and the holder and brush are only in combination useful.

Another known product is recited in Patent No. WO 2017/084672 A1, which relates to a storage device for a brush comprising of a flexible plastic container comprising an inside face and an outside face, where the plastic container comprises a tapered area between a first wider end towards a second narrower end where the tapered area on the inside face has a dimension allowing a fit with one or more sizes of brush heads. The flexibility of the plastic container is achieved with very thin plastic as film and a tearing line, usually used in plastic foil. A tapering angle $\alpha$ (alpha) is claimed between 10 and 40 degrees.

A drawback of this product is that it can only be used as a disposable which is not an environmental friendly solution.

Another drawback of this product is that, due to the vulnerability of the plastic container, the brush is not well protected against sharp edges of paintbrush heads especially rectangular ones, or other external sharp elements like in a toolbox.

Another drawback of this product is that this flexibility prevents a stand-alone straight-up position hence forcing a flat laydown which will cause leakage of paint towards the brush head and also prevents use of fluids to preserve the brush during long term storage.

Another drawback of this product is that the tapering angle of the container is between 10-40 degrees which is more than the common angle in which brush hair is usually cut, namely between 0 and 10 degrees, and this will cause squeezing of the hair and damage to the tips of the hair while inserting hence diminishing the quality of the paintbrush.

It is an object of the invention to provide a product of the type described above wherein these disadvantages do not occur.

SUMMARY OF THE INVENTION

According to the invention this is achieved by a paintbrush holder 1 comprising a brush holder part 2 that is open at a top for receiving a brush, with a volume, a spout-shaped part 3 on a top side of the brush-receiving part, wherein a largest diameter of the spout-shaped part is greater than a largest diameter of a brush which can be inserted in the receiving part, which comprises a lower and smallest diameter of the spout-shaped part that fits the average diameter of the head of the paintbrush, wherein the average diameter is typically found in a middle part of the brush head, and wherein the average diameter is taken as an average of the largest and smallest diameter of the brush head, plus or minus a few (2-3) percent, and wherein thus the sprout-shaped part contacts the brush head above about ⅓ of the height thereof, taken from the hair side to the holder side, typically from above 40% of said height, such as 50-70% thereof, that is on a typical length of a brush head of 3 cm above the lower 1 cm and typically below the upper 1 cm, where the volume of the brush-receiving part below the smallest diameter is greater than the volume of the brush hairs, in which at least a portion of the paintbrush holder is an elastomer 4, which elastomer is provided at the level of the smallest diameter of the spout-shaped part, which elastomer is adjusted to fluid-tightly close the volume and in which the spout-shaped part has a height which is such that a mass center of gravity of a received paintbrush falls into the paintbrush holder. This keeps the brush handle in upward direction as the whole is laid flat and let the liquid flow towards the bottom.

The brush-receiving part and spout-shaped part can be made as one part, or in which the spout-shaped part is detachably attached to the brush-receiving part, such as by means of a screw element 7 or clamping element, which screw or clamping element comprises an opening for receiving the spout-shaped part, and wherein the brush-receiving part is provided with corresponding screw or clamping elements. This allows it to be applied to a variety of preferably standard containers and be adjusted to the size of the brush or to one specific application such as for cleaning the brush.

It is noted that a paintbrush may be provided with a rail-like section, which is slightly larger in diameter than the brush head. It is preferred to contact the spout-shaped part above said rail. The brush may be considered to be suspended, which suspension is mainly or fully supported by the spout.

The present paintbrush holder can be used at least several times, and is not considered to be a disposable.

The spout-shaped part can be provided with a non-circular part, which non-circular part prevents rotation of the paintbrush holder.

The brush-receiving part narrows with an angle β of −5°-10°, preferably with an angle of −2°-8°, more preferably with an angle of 0°-5°, such as with an angle of 1°-4°. In view of volume provided for the brush hairs, protection of hairs, not touching of hairs by the brush-receiving part, and producibility, this is found to be a suitable angle.

In an embodiment of the present paintbrush holder, the brush-receiving part is tapered, such as tapered with an angle β<3°, such as with an angle β of <2°. Therewith the brush-receiving part can be made easier as for instance release of a mold is easier. The brush-receiving part is preferably made of a stiffer material than the spout shaped part, such as PP or PE.

The bottom of the brush-receiving part can be round but also flat so that the whole can be set upright.

In an embodiment of the present paintbrush holder is the volume of the brush-receiving part below the smallest diameter at least 20% larger than the volume of the bristles, preferably at least twice bigger, even better and at least four times larger, such as 5-10 times bigger.

In an embodiment of the present paintbrush holder, the entire holder is made of elastomer.

In an embodiment of the present paintbrush holder the holder may be made of a more rigid material, such as plastic, glass, or metal, like aluminum, and the brush head is fully or partly made of elastomer. This may be considered a mechanical equivalent of the present invention.

In an embodiment of the present paintbrush holder, the elastomer had a glass transition temperature of <273K.

In an embodiment of the present paintbrush holder, the paintbrush holder comprises an amorphous polymer.

In an embodiment of the present paintbrush holder, the paintbrush holder has am elasticity modulus (Young modulus) of <5 MPa.

In an embodiment of the present paintbrush holder the elastomer has a shore type A of 50-75 (ASTM D2240), preferably of 55-70, more preferably 60-67, such as about 65. This type of material is found to provide a good comprise between sufficient sealing and resilience.

In an embodiment of the present paintbrush holder, the paintbrush holder is transparent.

In an embodiment of the present paintbrush holder, the paintbrush holder has an elongation at break of >100%.

In an embodiment of the present paintbrush holder, the paintbrush holder is made of polyolefin, such as polyethylene or polypropylene.

In an embodiment the present paintbrush holder has a bottom that widens, such as widens by 5-10% of the diameter of the brush-receiving part. This is found to improve stability of the holder, especially when in use.

In an embodiment of the present paintbrush holder, the holder has a circular cross section, or an oval cross section, or a substantially rectangular cross section.

In an embodiment of the present paintbrush holder the brush-receiving part has a flat bottom.

In an embodiment of the present paintbrush holder, the elastomer fits on a middle diameter of the brush head.

In an embodiment of the present paintbrush holder the length is 8-20 cm, preferably 9-15 cm, such as 10-12 cm.

In an embodiment of the present paintbrush holder, the holder is injection-molded.

In an embodiment of the present paintbrush holder the spout-shaped part has a height of 1-3 cm, such as 1.5-2 cm.

In an embodiment of the present paintbrush holder, the spout-shaped part narrows under an angle γ of 60-80° with respect to a longitudinal axis, more preferably at an angle of 65-75°, such as 68-72°. That is the longitudinal axis is take to be under an angle of 90°, so 10-30°.

In a second aspect, the invention comprises an assembly comprising a paintbrush holder 1 and one matching paintbrush where the elastomer is as transparent as possible and fits on the middle diameter of the brush head, the length is 9-15 cm, of which the spout-shaped part has a length of 1-3 cm and is provided with an non-round (or off-rounded) part 9 that prevents the rotation of the paintbrush holder when it is laid down.

A second embodiment of the paintbrush holder consists of an assembly comprising a brush holder and a matching paintbrush with the spout-shaped part 3 as a whole consisting of an elastomer 4 and detachable from one, preferably from a transparent material existing, brush-receiving part 2 by means of a, preferably standard, screw element 7 thereby making it possible to attach the spout-shaped part to different size brush-receiving parts making easy adjustment to the brush length as well as to provide a brush-receiving part with a quantity brush cleaning fluid 8 in the space between the ends of the brush hairs and the bottom so that by shaking, the brush hairs can be cleaned. Because the brush-receiving part is transparent you can follow the cleaning process well and determine when the brush is clean without detaching the parts over and over. This allows to determine the paint color and the saturation of the solvent.

The invention is explained below on the basis of the following drawings.

Figure 1:
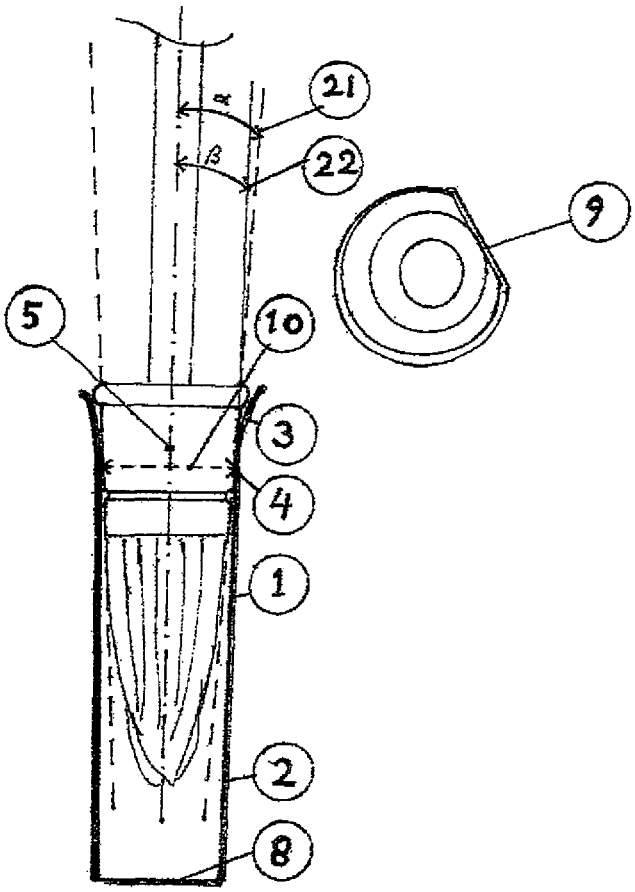
FIG. 1 shows the paintbrush holder according to the first embodiment of the invention.

FIG. 1 shows the paintbrush holder 1 comprising a brush-receiving part 2 a spout-shaped part 3 an elastomer at the smallest diameter of the spout-shaped part 4 with a height such that a point of mass 5 of a paintbrush to be received falls in the paintbrush holder with a flat bottom 8, the angle α of the tapered shape of the brush head 21 and of the receiving part β 22 as well as a top view with non-rounded part 9.

Figure 2:
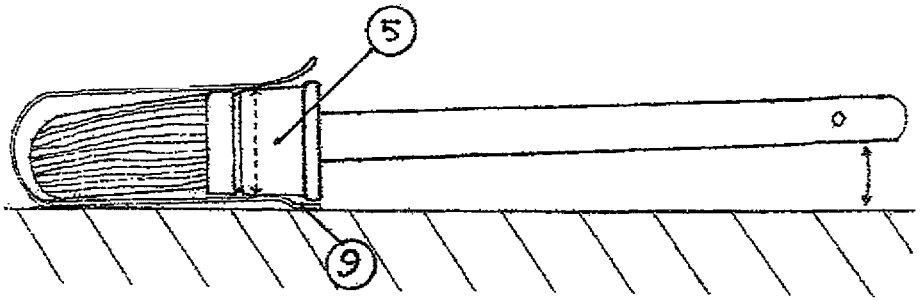
FIG. 2 shows the paintbrush holder according to the first embodiment of the invention in landscape position.

FIG. 2 shows the paintbrush holder in landscape position with the non-round part 9 and the mass center of gravity 5 falling in the paintbrush holder.

Figure 3:
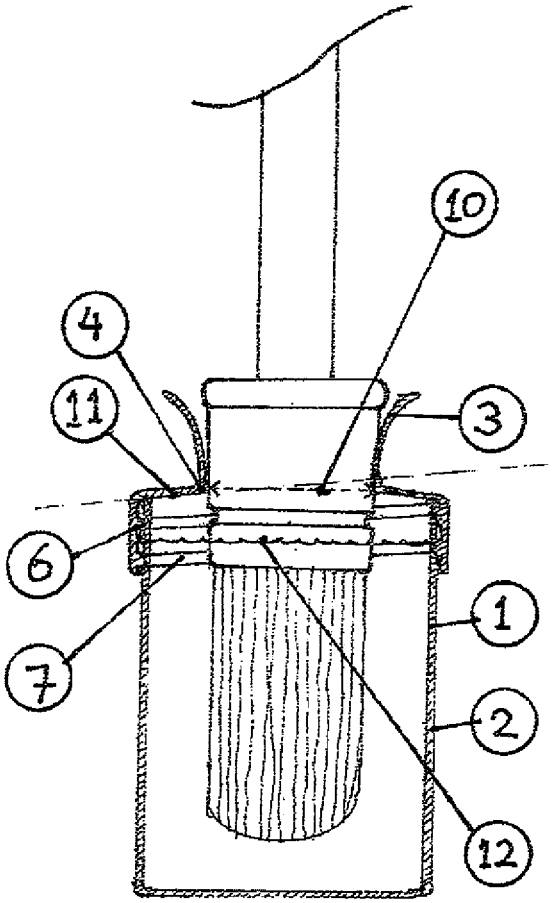
FIG. 3 shows the paintbrush holder according to the second embodiment of the invention.

FIG. 3 shows the paintbrush holder 1 comprising a brush-receiving part 2 a spout-shaped part 3 with upward part 11 for easy emptying, entirely consisting of an elastomer 4 with smallest diameter 10 wherein the brush-receiving part and spout-shaped are separable because the brush-receiving part is attached by means of a screw element 6 and 7, filled with brush cleaner 12.

Figure 4:
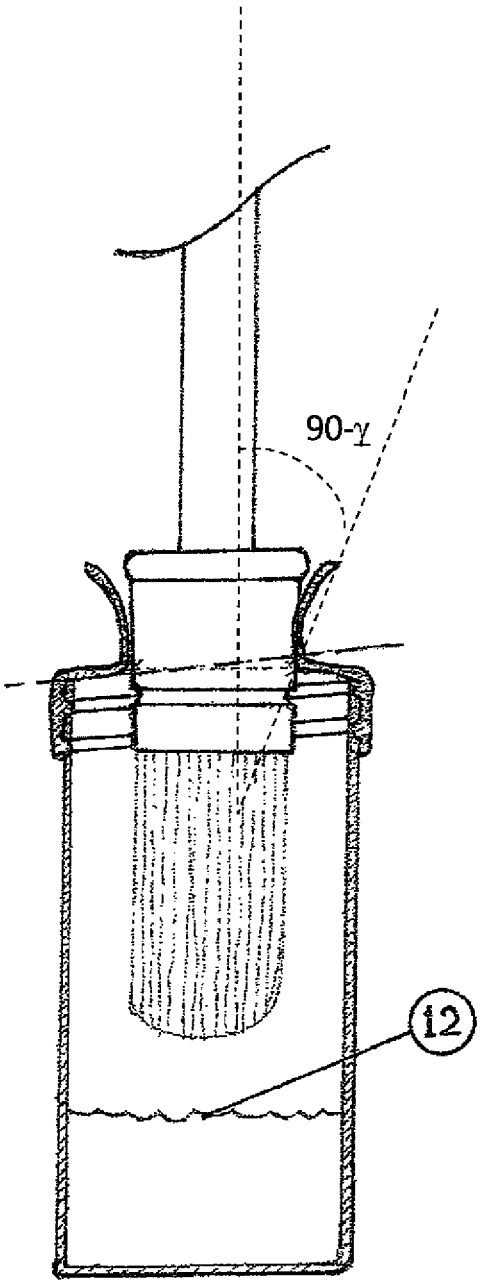
FIG. 4 shows the paintbrush holder according to the second embodiment of the invention with a larger brush-receiving part adapted for cleaning the brush.

FIG. 4 shows the same paintbrush holder as in FIG. 3 where the brush-receiving part is much larger in volume and there is room for brush cleaning fluid 12 between the hairs and the bottom so that, by shaking, the brush hairs can be cleaned.

Figure 5:
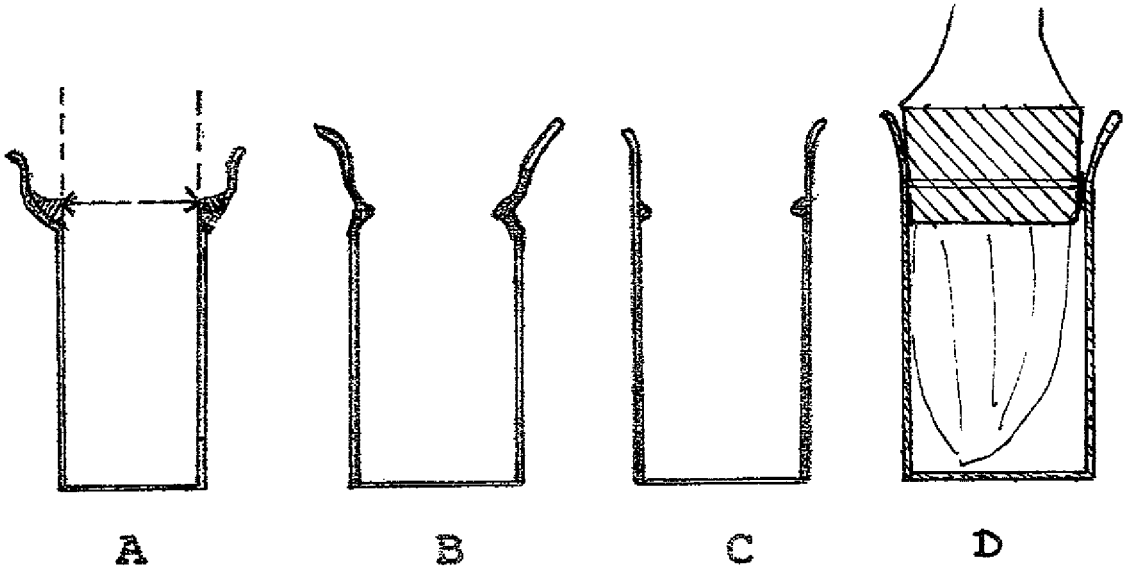
FIG. 5 shows a number of variants of the first embodiment.

FIG. 5 shows a number of varieties of the first embodiment in which:

A shows an embodiment that is easily releasable from an injection mold with a 2nd component being an elastomer for the seal;

B shows an embodiment that does not easily reject from an injection mold;

C an embodiment in which the container has an elastomer ring for sealing to be made with $2^{nd}$ injection molding technique.

D shows the first embodiment consisting of more rigid material, like plastic, glass, or metal, like aluminum, and the brush head consisting fully or partly of elastomer.

Figure 6:
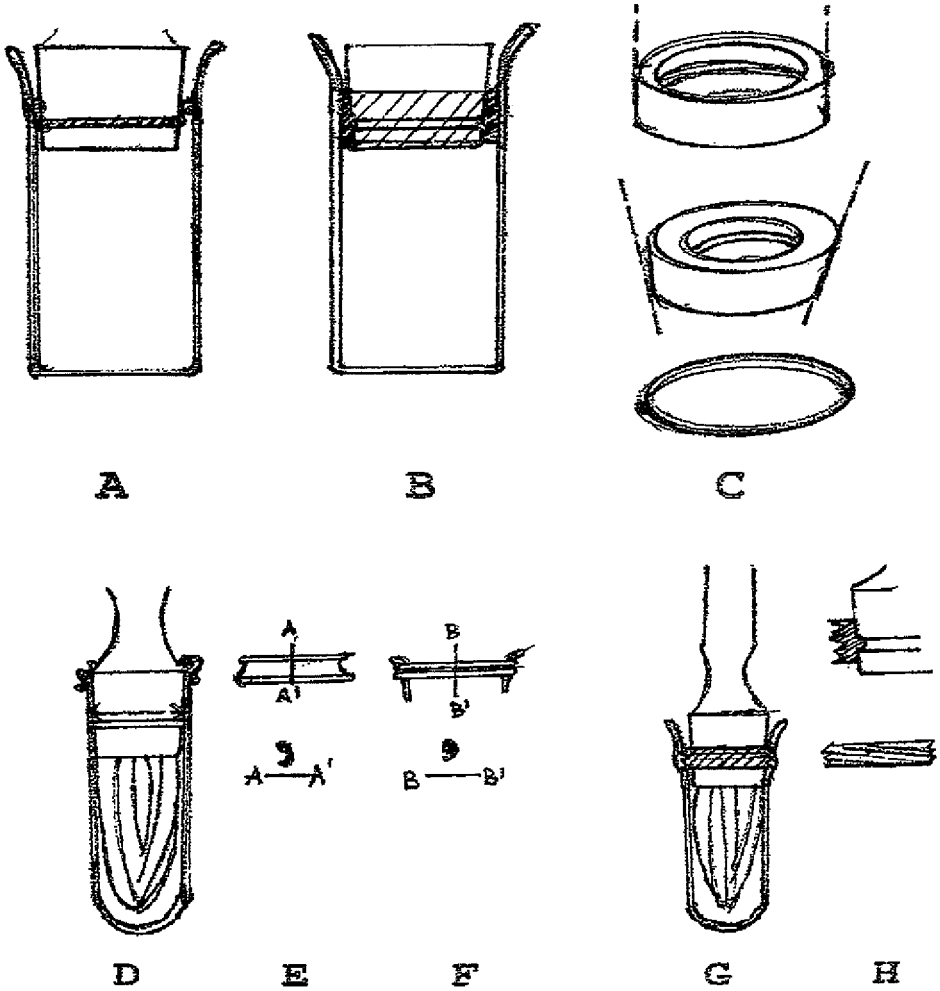
FIG. 6 shows the first embodiment with additional sealants.

FIG. 6 shows the first embodiment with additional sealants in which in:

A a round elastic sealing is applied around the brush head;

B a flat elastic band is applied around the brush head;

C types of elastic bands are shown for sealing with in the middle a tapered band for a forced sealing.

D shows an elastic band consisting of two rings with a foil in between with one ring on the brush-receiving part and the other on the brush so that the space between brush and brush-receiving part is complete airtight sealed;

E shows the ring in closed form and;

F represents the ring in the rolled-up state which can remain on the brush-receiving part or on the brush;

G shows a seal with a thread wherein the thread is applied on a rubber band that itself can be applied on a standard brush head;

H demonstrates how the rubber band with screw thread such as indicated in Figure G on the brush head is applied.

Figure 7:
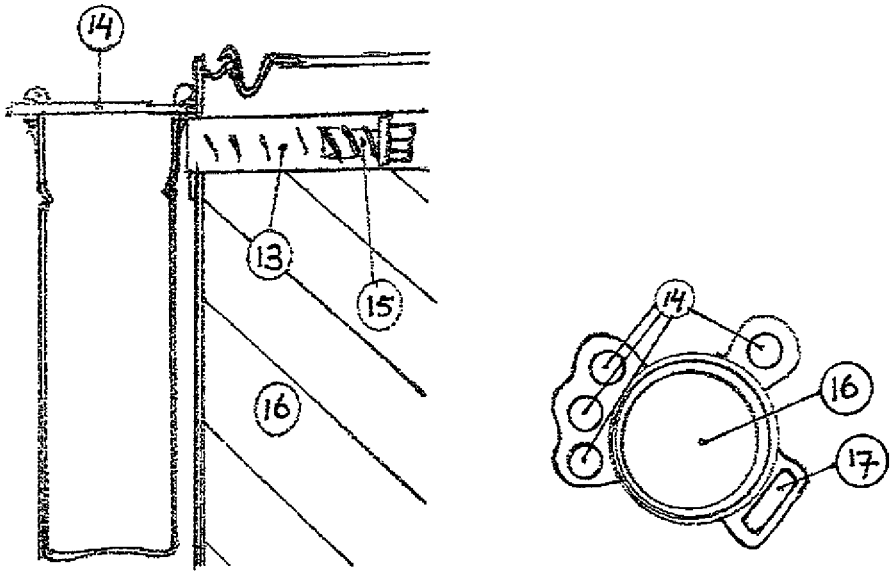
FIG. 7 shows fasteners for the first embodiment.

FIG. 7 shows fasteners for the first embodiment consisting of a band 13 with holders 14, 17 which can be easily arranged around a paint can 16 and attached firmly by a closure device 15.

Figure 8:
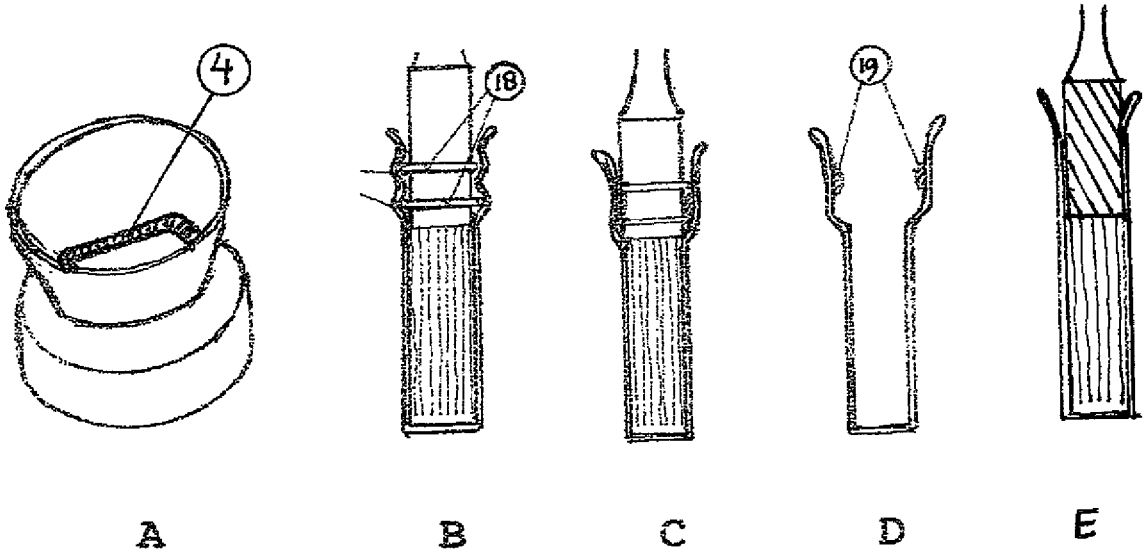
FIG. 8 shows the application for flat brushes.

FIG. 8 shows the invention applied to flat brushes where:

A shows the second embodiment of the invention with an elastomer seal 4 suitable for flat brushes;

B shows the first embodiment where the shape of the brush holder is adjusted to the shape of the brush with ribs 18 which lingers in the brush-receiving part;

C shows the first embodiment in which the form of the brush holder is adjusted to the shape of the brush head and will, in combination with a rubber band, hang in the holder and be sealed airtight;

D shows the first embodiment in which the form of the holder is adjusted to the shape of the brush head and through an elastomer applied on the inside of the container 19 is sealed airtight.

E shows the first embodiment wherein the holder is made of more rigid material, such as plastic, glass, or metal, like aluminum, and the brush head is fully or partly made of elastomer.

The invention claimed is:

1. A paintbrush holder, comprising a brush-receiving part that is open at the top for receiving a brush, with a volume, a spout-shaped part provided on a top side of the brush-receiving part, wherein a largest diameter of the spout-shaped part is larger than a largest diameter of a brush to be received in the brush-receiving part, in which a lower and smallest diameter of the spout-shaped part fits the average diameter of the head of the paintbrush to be received, wherein the volume of the brush-receiving part below the smallest diameter is larger than the volume of the brush hairs to be received, wherein the brush-receiving part narrows with an angle of −5°-10°, wherein at least a part of the paintbrush holder comprises a solid elastomer, which solid elastomer is provided at the level of the smallest diameter of the spout-shaped part, which solid elastomer is adapted to close the volume airtight and liquid tight, and wherein the spout-shaped part has a height such that a mass center of gravity of a paintbrush to be received falls in the paintbrush holder, wherein the solid elastomer has a shore type A of 50-75.

2. The paintbrush holder according to claim 1, wherein the brush-receiving part and spout-shaped part are made as one part.

3. The paintbrush holder according to claim 1, wherein the spout-shaped part is provided with a non-round part, which non-round part prevents rotation of the paintbrush holder, and wherein the brush-receiving part is tapered.

4. The paintbrush holder according to claim 1, wherein the volume of the brush-receiving part below the smallest diameter is at least 20% greater than the volume of the brush hairs.

5. The paintbrush holder according to claim 1, wherein the entire paintbrush holder is made of a material selected from a solid elastomer.

6. The paintbrush holder according to claim 1, wherein the solid elastomer has at least one of a glass transition temperature of <273K, comprising an amorphous polymer, an elastic modulus (Youngs modulus) of <5 MPa, and an elongation at break of >100%.

7. The paintbrush holder according to claim 1, wherein the brush-receiving part has a cross section selected from circular, oval, and substantially rectangular.

8. The paintbrush holder according to claim 1, the solid elastomer fitting to a middle one diameter of the brush head.

9. The paintbrush holder according to claim 1, wherein a length, of the paintbrush holder being 8-20 cm.

10. The paintbrush holder according to claim 1, wherein the paintbrush holder is injection molded.

11. The paintbrush holder according to claim 1, wherein the spout-shaped part has a height of 1-3 cm.

12. The paintbrush holder according to claim 1, wherein the spout-shaped part is detachably attached to the brush-receiving part by means of a screw element or clamping element, which screw or clamping element comprises an opening for receiving the spout-shaped part, and wherein the brush-receiving part is provided with the corresponding screw or clamping elements.

13. An assembly comprising the paintbrush holder according to claim 1 and a matching paintbrush.

* * * * *